United States Patent [19]

Parren

[11] Patent Number: 4,576,839

[45] Date of Patent: Mar. 18, 1986

[54] DECORATIVE HOLDER

[76] Inventor: Joseph R. Parren, 19638 N. 34th Dr., Phoenix, Ariz. 85027

[21] Appl. No.: 673,143

[22] Filed: Nov. 19, 1984

[51] Int. Cl.[4] ..... A47G 29/10

[52] U.S. Cl. ..... 428/13; 40/2 A; 40/330; 70/456 R; 206/87; 428/136

[58] Field of Search ..... 70/456 R, 457; 40/2 A, 40/330; 206/85, 87, 457; 428/13, 136, 28, 68, 542.2

[56] References Cited

U.S. PATENT DOCUMENTS

| | | | |
|---|---|---|---|
| 1,841,266 | 1/1932 | Jones | 40/330 X |
| 2,511,552 | 6/1950 | Stuempges | 428/13 |
| 4,188,741 | 2/1980 | Levy | 40/2 A X |
| 4,330,578 | 5/1982 | Nishihira et al. | 428/28 X |
| 4,457,425 | 7/1984 | Cooper et al. | 428/900 X |

*Primary Examiner*—Henry F. Epstein

*Attorney, Agent, or Firm*—Gregory J. Nelson

[57] ABSTRACT

An ornamental holder for objects such as disposable lighters, cosmetics and the like having a body with front and sides configured to engage the contained object. The front side defines a transparent viewing window having an interior and exterior surface. A suitable design or ornamentation is placed at the interior surface and the transparent window and provides a lens effect to enhance the visual effect of the ornamentation.

7 Claims, 5 Drawing Figures

DECORATIVE HOLDER

The present invention relates to a holder for articles and more particularly relates to a decorative holder or sleeve for articles such as cigarette lighters, lipsticks and other cosmetic or personal use items.

Manufacturers of accessory items such as cosmetics, cigarette lighters, and similar articles, often house these items in generally elongate circular or oval holder which are made of plastic or similar material and are generally ordinary in appearance. The purpose of such containers is to provide an inexpensive container which may be discarded after use. Typical of such container construction is the design of disposable butane lighters. Such lighters have gained wide acceptance because they are inexpensive, convenient to use and are disposable. Accordingly, the manufacturers of such lighters have provided housings of the type described above which are generally elongate and are oval in cross-section or of some similar cross-section. One of the most popular of such brands is the lighter sold under the trademark "BIC" which corresponds to the configuration above.

Because of the rather ordinary appearance of such lighters, various decorative holders or sleeves can be found in the prior art. Generally these holders or sleeves are of uniform thickness and configured to accomodate the lighter. Generally the sleeve extends entirely about the lighter and the sleeve exterior is provided with some sort of surface of ornamentation or decoration. Typical of this type of holder is a metal sleeve carrying initials or other decorative surface ornamentation. Such cases have found limited acceptance, generally because of their appearance or their expense. Accordingly, there exists a need in the art for an improved decorative holder or sleeve for articles such as those described which can be manufactured inexpensively, which provide good tactile feel to the user and which affords a wide variety of latitude in the type of ornamentation that may be applied.

Briefly, the present invention comprehends a sleeve or holder for generally elongate, tubular-type articles which sleeve defines an interior opening at least partially conforming to the cross-sectional configuration of the article to be received so the article can either be slipped into the opening or clipped in place. The front surface of the holder is of increased cross-sectional depth and at least a part of the front surface is transparent forming a viewing section. Accordingly, appropriate ornamentation can be applied at the interior surface of the front viewing section. The ornamentation may consist of an insert at this location, engraving, stamping, surface carving or other ornamentation which preferably gives a three-dimensional effect such as a rainbow hologram. The ornamentation is protected by the viewing surface and the viewing surface further serves as a lens to enhance and magnify the appearance of the ornamentation.

The above and other objects and advantages of the present invention will become more apparent from the following specification, claims and drawings in which:

Figure 1:
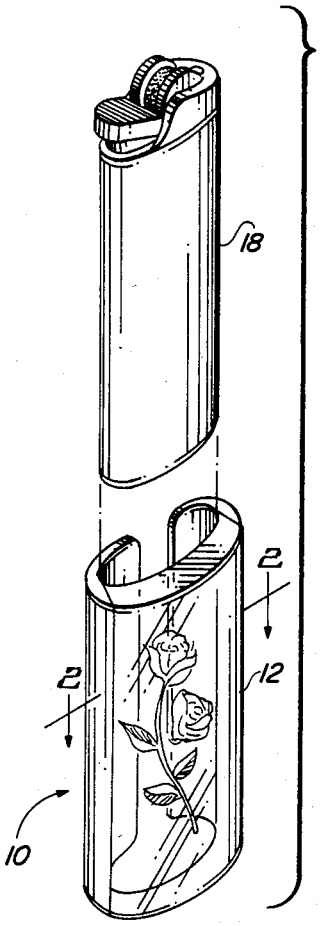
FIG. 1 is a perspective view of a preferred embodiment of an article holder constructed according to the present invention along with the article to be inserted in the holder.
Figure 2:
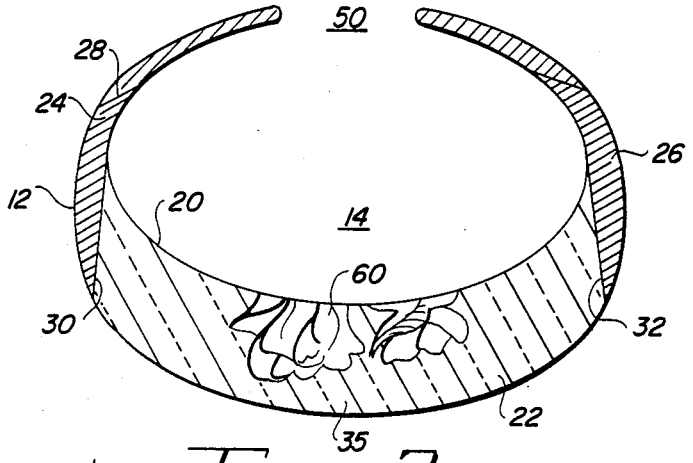
FIG. 2 is a cross-sectional view taken along lines 2—2 of FIG. 1.
Figure 4:
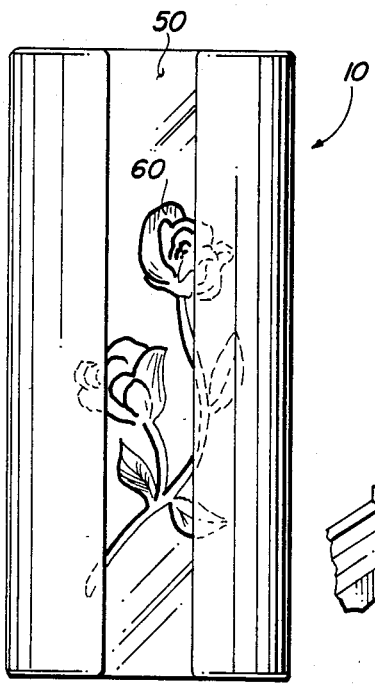
FIG. 4 is a rear view of the holder shown in FIGS. 1 and 2.

Turning now to the drawings, FIGS. 1, 2 and 4 show a preferred embodiment of the present invention generally designated by the numeral 10. Decorative article holder 10 has a body 12 which is generally elongate defining an oval opening 14 to snugly receive the body of conventional butane cigarette lighter 18. As is best seen in FIG. 2, the body 12 has a front section 22 having an inner surface 20 which conforms to a portion of the oval configuration of the object 18. Retaining members 24 and 26 extend at opposite sides of section 22. The retaining members 24 and 26 may extend and completely encircle or enclose the object 18 or, as shown, may simply extend rearwardly a sufficient distance to retain the object in place with a portion of the object being exposed at the rear of the holder. Accordingly, the opposite retaining members 24 and 26 taper at 28 to smoothly form a transition to the exposed portion of the object 18. An opening 50 extends between the retaining members 24 and 26.

The front section 22 of the holder is generally transparent in the area extending between the numerals 30 and 32 forming a viewing window 35. Preferably, the viewing window extends the entire length of the object but in any event provides a substantial transparent area for ornamentation. The transparent window area designated by the numeral 35 has at least one curved surface and tapers slightly at either edge into the opposite retaining members 24 and 26. In this way, the viewing window 35 is in the form of a lens which, as will be explained hereafter, enhances the visual effect of the applied ornamentation.

The holder as described above may be formed as an integral unit as by extruding or may be formed from several pieces joined together by appropriate bonding techniques. For example, the front section 35 could be formed of a transparent lucite plastic with the opposite retaining members 24 and 26 joined at the sides of the front section and being transluscent or opaque.

Appropriate decoration and ornamentation 60 is provided at the interior surface 20 of the viewing window. In its simplest form, the ornamentation can simply be the insertion of a business card or photograph which will then be held in place when the contained object 18 is secured in place. The viewing window 35 in the form of a lens will protect the card or photograph and the characteristics of the lens will serve to enhance and dramatize the photograph. A rainbow hologram may also be inserted which reflects white light to create a changing three-dimensionally appearing image.

With the embodiment as shown in FIGS. 1, 2 and 4, it is noted that a substantial open area 50 exists at the rear of the holder. The area 50 may serve as a tool working area for access to the interior surface 20. Accordingly, surface 20 provides a location for placement of ornamentation 60. Ornamentation 60 may be placed on surface 20 by various means and is preferably three-dimensional being cast in place, engraved, hot-stamped, surface carved or internally carved. The ornamentation 60 being on the interior surface, leaves the exterior surface smooth and protects the ornamentation from wear and contamination. Further, because of the lens effect imparted by the viewing window, the ornamentation when viewed from the outside is substantially enhanced and provides a three dimensional visual effect.

Thus, the holder of the present invention can be easily secured about any product, preferably disposable products such as lighters, cosmetic items and the like. The ornamentation provided on the inner surface 20 is decorative and enhances the appearance of the enclosed object. Further, the overall shape of the object provides a good tactile feel in addition to imparting the three-dimensional effect of the ornamentation at the viewing window. The opening 50 at the rear, as best shown in FIG. 4, provides convenient working access for the placement of the ornamentation.

Figure 3:
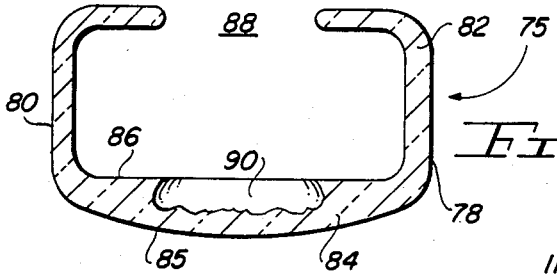
FIG. 3 is a cross-sectional view illustrating an alternate configuration of a holder according to the present invention.

FIG. 3 is a cross-sectional view illustrating another embodiment of the present invention generally designated by the numeral 75. In this embodiment, the holder again has a generally elongate body 78 with opposite side retention members 80 and 82 and front section 84 having exterior surface 85 and an interior surface 86. In the embodiment 75, the interior configuration defined by the front surface and members 80, 82 is generally rectangular to receive an object of a generally rectangular shape. Again, an access opening 88 is provided between the terminal ends of the retention members so that an appropriate ornamentation or design 90 can be imparted to the interior surface 86 in the manner described above. Front section 84 again has at least one curved surface and is transparent for viewing the ornamentation 90.

Figure 5:
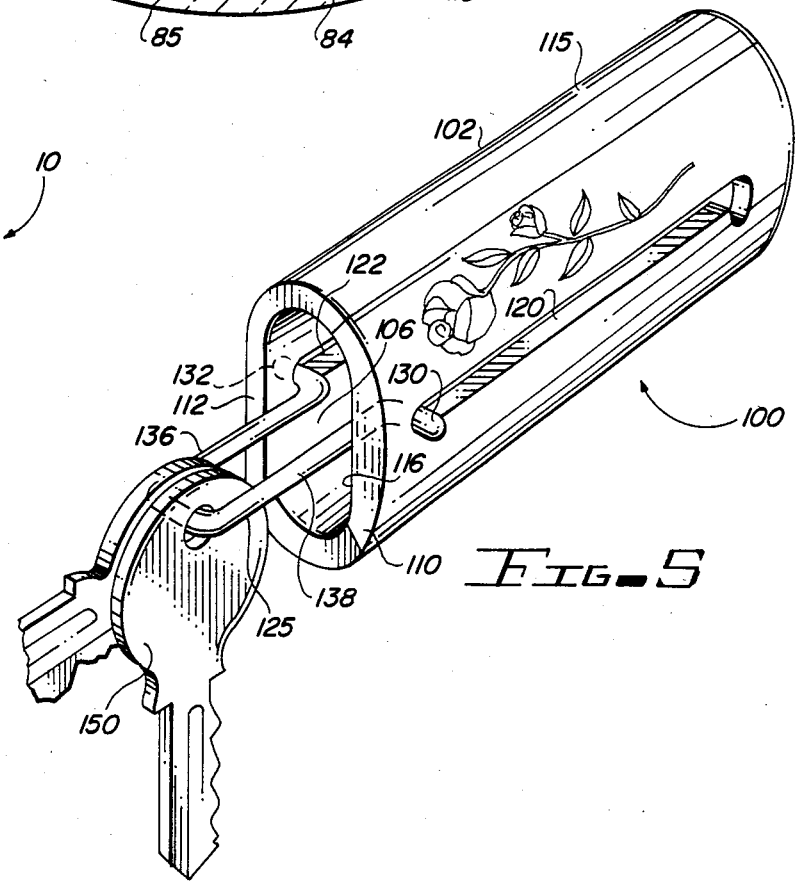
FIG. 5 shows a perspective view of another embodiment of the present invention in which the holder according to the invention is configured to receive one or more keys.

FIG. 5 shows another embodiment of the present invention generally designated by numeral 100. In FIG. 5, holder 100 is shown from the rear and again includes a body 102 which is in the form of generally elongate sleeve defining an axially extending opening 106 which is generally oval in configuration. Body 102 defines a transparent front surface 110 and rear section 112. The front surface 110 defines a transparent lens 115 having an interior surface 116. The interior surface 116 is provided with suitable ornamentation or design which design or ornamentation is enhanced to the viewer through the front section 115.

Axially extending slots 120 and 122 are oppositely provided in the front and rear sections, respectively, of body 12. Generally U-shaped carrier 125 has followers 130 and 132 reciprocal in slots 120 and 122, respectively. Carrier 125 is resilient and by depressing the opposite arms 136 and 138, the followers 130 and 132 are disengaged from their slot and the carrier removed for attachment or removal of keys 150. Thus, when the user wishes to utilize the keys, the keys can be appropriately advanced from the lower retracted position to the extended position by the slide or carrier. The holder 100 provides a convenient shape with the proper tactile feel and provides the added ornamentation.

It will be apparent to those skilled in the art to make various changes, alterations and modifications to the invention described herein. To the extent that these various alterations, modifications and changes do not depart from the spirit and scope of the appended claims, they are intended to be encompassed therein.

I claim:

1. An ornamental holder for a generally elongate object comprising:

(a) a generally elongate body having a front section and opposite sides defining an opening generally adapted to receive the object;

(b) said front section defining a transparent viewing window having an exterior surface and interior surface with the said interior surface adapted to receive ornamentation, said exterior surface being curved to form a lens to enhance the ornamentation at said interior surface when viewed from the exterior surface.

2. The ornamental holder of claim 1 wherein said exterior surface is generally convex.

3. The ornamental holder of claim 1 wherein said body includes opposite retaining members which engage opposite portions of the contained object and further wherein said retaining members define an opening therebetween which is an access work area for imparting the said ornamentation.

4. The ornamental holder of claim 1 wherein ornamentation is imparted at the interior surface of said viewing window and is three dimensional.

5. The ornamental holder of claim 1 wherein said ornamentation comprises an insert at said interior surface having material imprinted thereon.

6. The ornamental holder of claim 1 wherein said body defines an elongate slot and wherein slide means is reciprocable in said opening along said slot.

7. The ornamental holder of claim 6 wherein said slide means is adapted to removably receive a key.

* * * * *